United States Patent [19]

Shenier

[11] Patent Number: 4,579,253

[45] Date of Patent: Apr. 1, 1986

[54] TONER CONTROL SYSTEM

[75] Inventor: Richard S. Shenier, Elmhurst, N.Y.

[73] Assignee: Savin Corporation, Stamford, Conn.

[21] Appl. No.: 296,970

[22] Filed: Aug. 27, 1981

Related U.S. Application Data

[63] Continuation of Ser. No. 797,620, May 17, 1977, abandoned.

[51] Int. Cl.[4] ..... G03G 15/00

[52] U.S. Cl. ..... 222/56; 222/DIG. 1; 250/225; 250/565; 250/575

[58] Field of Search ..... 222/56, 57, DIG. 1; 250/225, 229, 565, 575, 209; 356/206; 118/646

[56] References Cited

U.S. PATENT DOCUMENTS

| | | | |
|---|---|---|---|
| 2,073,223 | 3/1937 | Rose | 250/229 X |
| 2,423,320 | 7/1947 | Hurley | 250/225 X |
| 3,233,781 | 2/1966 | Grubbs | 222/DIG. 1 X |
| 3,617,757 | 11/1971 | Burr et al. | 250/575 |
| 3,635,373 | 1/1972 | Kuhl et al. | 222/DIG. 1 X |
| 3,745,348 | 7/1973 | Kummeke | 250/575 |
| 4,222,497 | 9/1980 | Lloyd et al. | 222/DIG. 1 |

*Primary Examiner*—F. J. Bartuska
*Attorney, Agent, or Firm*—Shenier & O'Connor

[57] ABSTRACT

An improved toner control system having a pair of matched photosensitive devices connected in series and receiving equal amounts of light, wherein one device responds to light transmitted through the toner-containing developer and the other device responds to light transmitted through an adjustable aperture or attenuator.

14 Claims, 5 Drawing Figures

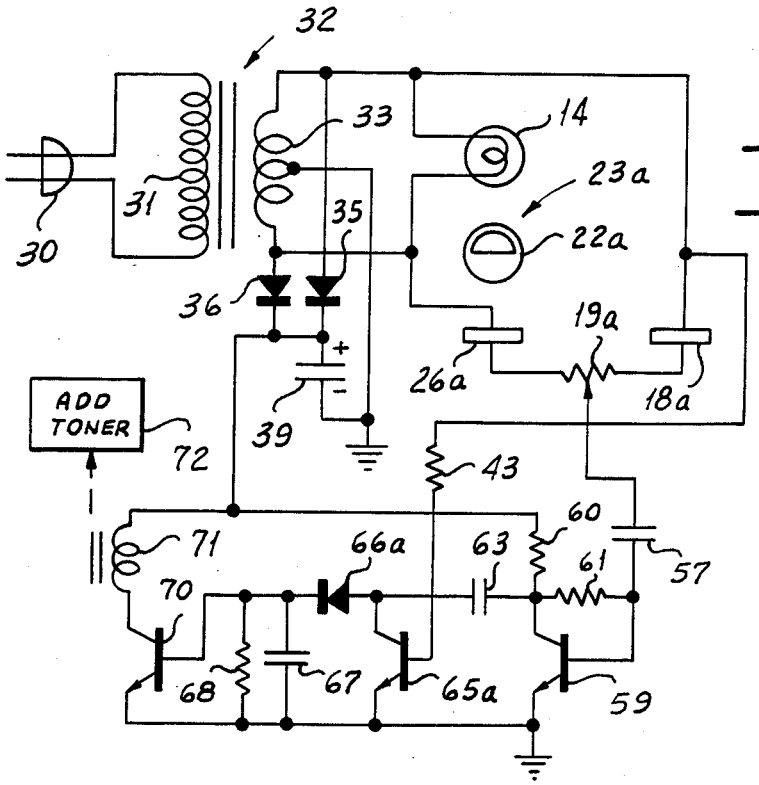
FIG 3
FIG 4
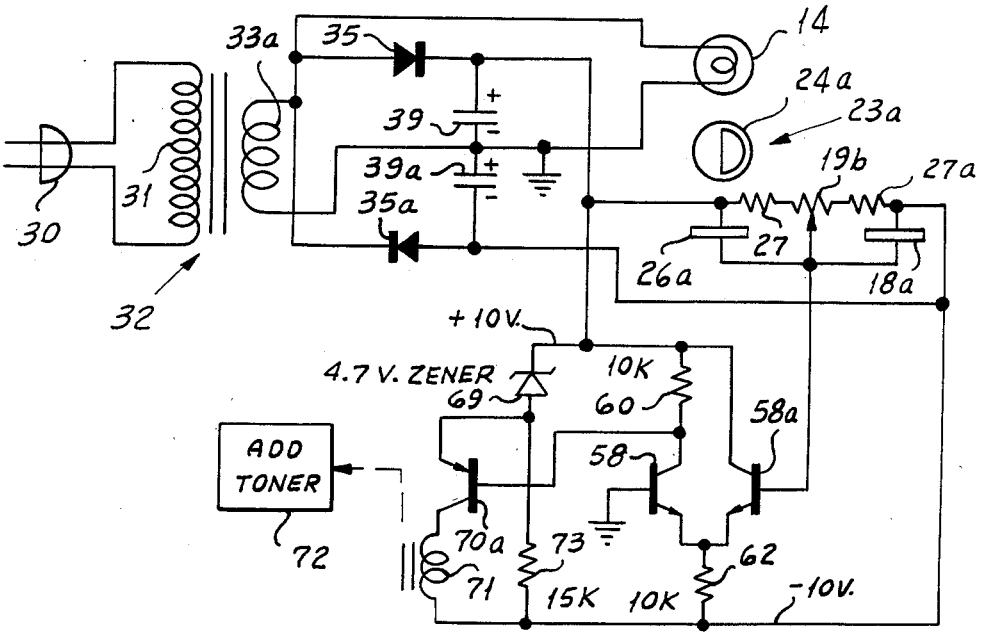

TONER CONTROL SYSTEM

This application is a continuation of my copending application Ser. No. 797,620, filed May 17, 1977, now abandoned.

BACKGROUND OF THE INVENTION

This application is an improvement over Grubbs U.S. Pat. No. 3,233,781 for Toner Control System. This patent shows a system wherein a pair of photoconductive devices are connected in parallel by resistances to form a bridge circuit having four resistance arms. The bridge is manually adjusted to null at the desired toner density by varying one of the resistance arms of the bridge. Photoconductive devices, however, are sensitive to temperature; and the equivalent circuit of such devices may be considered as a light responsive resistance shunted by a temperature responsive resistance. The null point of the Grubbs circuit will thus shift as a function of temperature unless the setting of the manually adjustable arm of the bridge happens to be such that equal amounts of light or luminous flux fall on the two photoconductive elements. However, where it is desired to vary the toner density to meet particular requirements, the null point of the bridge becomes increasingly temperature sensitive; and a manual adjustment which is satisfactory when a xerographic machine is first started may become unsatisfactory at a later time due to the increase in ambient temperature caused by operation of the machine.

SUMMARY OF THE INVENTION

One object of my invention is to provide an improved toner control system having a pair of matched photosensitive devices connected in series and receiving substantially equal amounts of light.

Another object of my invention is to provide an improved toner control system wherein mismatch in the photosensitive devices is compensated for.

Another object of my invention is to provide an improved toner control system having a pair of photovoltaic devices connected in series opposition.

Still another object of my invention is to provide an improved toner control system having a pair of photoconductive devices connected in series across a balanced, three-wire, low impedance source of potential.

A further object of my invention is to provide an improved toner control system wherein the desired null point is manually adjusted by controlling the amount of light or total luminous flux falling upon a reference photosensitive device.

Still a further object of my invention is to provide an improved toner control system wherein the null point is manually adjusted by governing the intensity of light falling upon a reference photosensitive device.

A still further object of my invention is to provide an improved toner control system wherein the null point is manually adjusted by a pair of relatively rotatable polarizers.

A still further object of my invention is to provide an improved toner control system wherein the null point is manually adjusted by a variable optical aperture.

Other and further objects of my invention will appear from the following description.

BRIEF DESCRIPTION OF THE DRAWINGS

In the accompanying drawings which form part of the instant specification and which are to be read in conjunction therewith and in which like reference numerals are used to indicate like parts in the various views.

FIG. 3 is schematic view showing a pair of series connected photoconductive cells receiving alternating current excitation from a center-tapped transformer and a second form of adjustable optical aperture.

FIG. 4 is a schematic view showing a pair of series connected photoconductive cells excited by a balanced, three-wire, direct-current source of relatively low impedance.

DESCRIPTION OF THE PREFERRED EMBODIMENT

Figure 1:
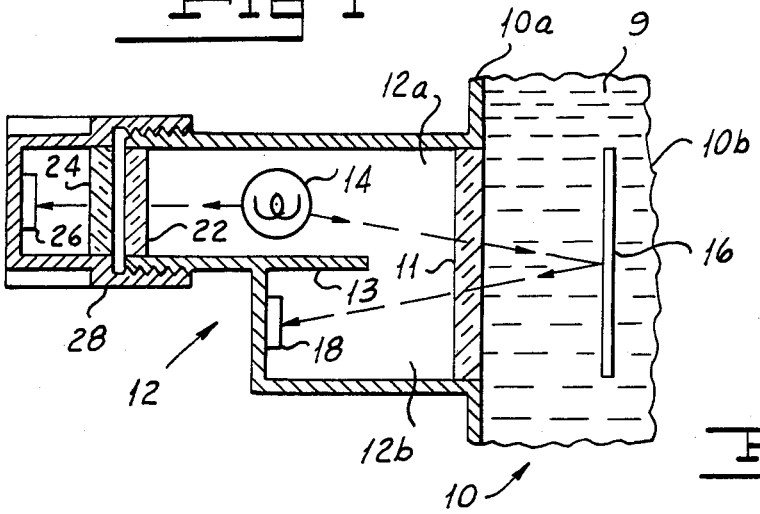
FIG. 1 is a sectional view showing the disposition of parts in an embodiment employing a pair of relatively rotatable polarizers for controlling the intensity of light falling upon the reference cell.

Referring now to FIG. 1 of the drawings, a tank 10 contains a supply of a liquid developer 9 comprising toner particles dispersed in a carrier liquid. One side wall 1O*a* of container 10 is provided with a transparent glass or plastic window 11. A planar mirror 16 is mounted within the tank 10 spaced from the window 11 and secured to a back wall 1O*b* of the tank 10. Formed integrally with wall 1O*a* or attached thereto is an assembly 12 comprising an upper tubular chamber 12*a* and a lower tubular chamber 12*b*. An incandescent lamp 14 is mounted within chamber 12*a*. Light from lamp 14 passes through window 11, thence through the liquid developer striking mirror 16 where it is reflected back through the liquid developer and window 11 to impinge upon a photovoltaic cell 18 mounted in chamber 12*b*. The common wall 13 of chambers 12*a* and 12*b* prevents direct impingement of light from lamp 14 upon device 18. Mounted at the end of chamber 12*a* is a polarizer 22. The tubular chamber 12*a* is provided with external screw threads which cooperate with internal screw threads on a manually rotatable cap 28. Cap 28 carries a polarizer 24 and a reference photovoltaic cell 26. Light from lamp 14 passes through polarizers 22 and 24 to impinge upon reference photocell 26.

In FIG. 1 the total light falling on reference cell 26 is varied by turning cap 28 and hence rotating polarizer 24 relative to polarizer 22. When the planes of polarization of polarizers 22 and 24 are parallel, the intensity of light from lamp 14 falling on cell 26 is about half that which would exist if both polarizers were removed. When the planes of polarization of polarizers 22 and 24 are at right angles to one another, the intensity of light from lamp 14 falling on cell 26 approaches zero. Thus, a wide range in the intensity of light falling upon reference cell 26 may be obtained by rotating cap 28 through a total angle of 90°.

Figure 2A:
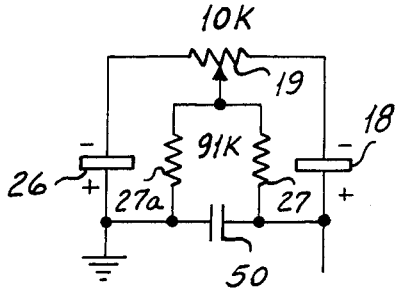
FIG. 2*a* is a fragmentary schematic view which should be read in conjunction with FIG. 2 showing a circuit for matching the characteristics of the pair of photovoltaic cells.
Figure 2:
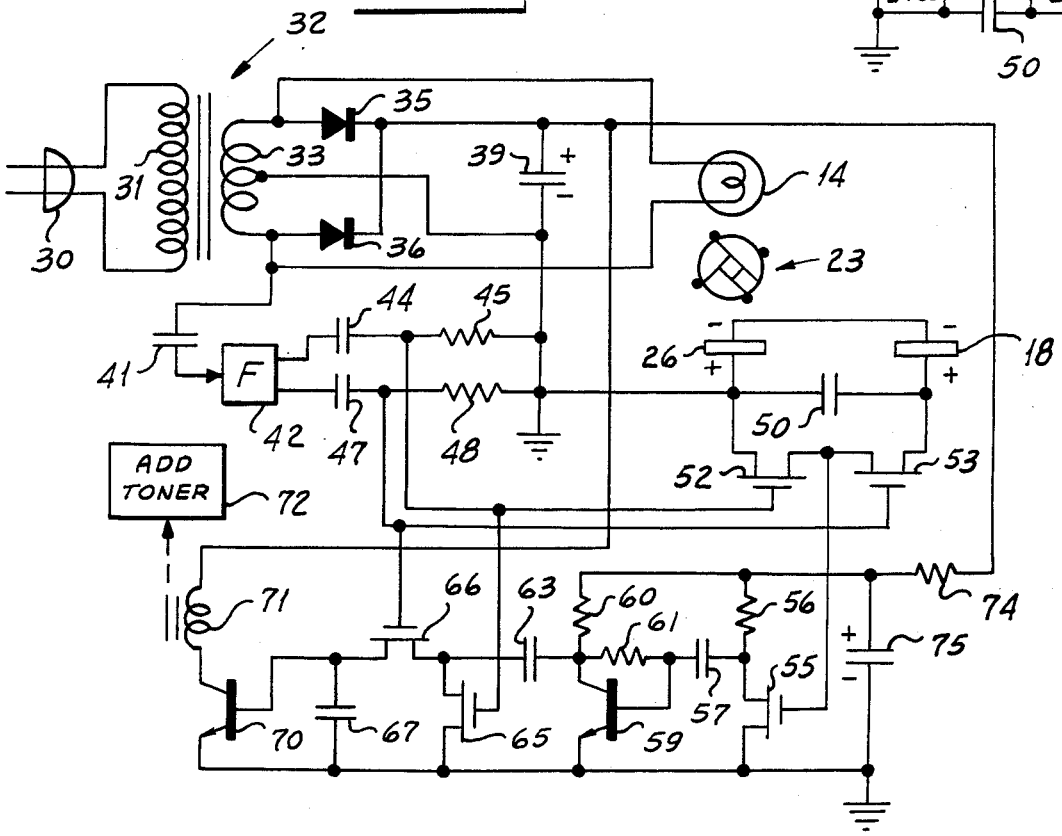
FIG. 2 is a schematic view showing a pair of photovoltaic cells connected in series opposition and a first form of adjustable optical aperture for controlling the amount of light falling upon the reference cell.

Referring now to FIG. 2 of the drawings, a wall plug 30 receives a standard line supply of 115 VAC at 60 Hz.

Wall plug 30 is connected across the primary winding 31 of a step-down transformer 32, having a center-tapped secondary winding 33. The center tap of winding 33 is grounded; and the two terminals of winding 33 are connected across the incandescent lamp 14. The terminals of winding 33 are also connected forwardly through respective diodes 35 and 36 to the positive terminal of a capacitor 39, the negative terminal of which is grounded.

In FIG. 2, a variable optical aperture 23 is used to control the amount of light falling upon the reference photovoltaic cell 26. The variable aperture 23 may have a plurality of rotatable leaves and may be constructed in substantially the same manner as the f-stop control on a camera.

The positive terminal of reference photovoltaic cell 26 is grounded; and the negative terminal thereof is connected to the negative terminal of photovoltaic cell 18. The positive terminals of cells 18 and 26 are connected to each other through a capacitor 50. The drain of an n channel, insulated gate, field effect transistor (IGFET) 52 is grounded, and the source thereof is connected to the source of a similar IGFET 53. The drain of transistor 53 is connected to the positive terminal of photovoltaic cell 18. The sources of transistors 52 and 53 are connected to the gate of a similar IGFET 55, the source of which is grounded. The positive terminal of capacitor 39 is connected through a decoupling resistor 74 to the positive terminal of a decoupling capacitor 75, the negative terminal of which is grounded. The positive terminal of decoupling filter capacitor 75 is connected through a resistor 56 to the drain of transistor 55. The drain of transistor 55 is connected through a capacitor 57 to the base of n-p-n transistor 59, the emitter of which is grounded. The positive terminal of capacitor 75 is connected through a resistor 60 to the collector of transistor 59. The collector of transistor 59 is connected through a biasing resistor 61 to the base of transistor 59. The collector of transistor 59 is connected through a capacitor 63 to the drain of an n channel IGFET 65, the source of which is grounded. The drain of transistor 65 is connected to the drain of a similar transistor 66. The source of transistor 66 is connected to ground through a capacitor 67 and to the base of an n-p-n transistor 70, the emitter of which is grounded. The positive terminal of capacitor 39 is connected through a winding 71 to the collector of transistor 70. Winding 71 actuates a relay or other means 72 for adding toner to the diluent dispersing liquid in tank 10, as shown in Grubbs. The anode of diode 36 is coupled through a capacitor 41 to the input of a flip-flop 42. One output of flip-flop 42 is serially coupled through a capacitor 44 and a resistor 45 to ground. The other output of flip-flop 42 is serially coupled through a capacitor 47 and a resistor 48 to ground. The junction of capacitor 44 and resistor 45 is connected to the gates of transistors 52 and 65. The junction of capacitor 47 and resistor 48 is connected to the gates of transistors 53 and 66.

In operation of the circuit of FIG. 2, photovoltaic cells 18 and 26 are connected in series opposition so that with equal amounts of light falling on both cells, the voltage across capacitor 50 will be zero. Transistors 52 and 53 serve as a chopper to convert the DC voltage across capacitor 50 into a square-wave AC voltage at the gate of transistor 55. Transistors 55 and 59 serve as AC amplifiers. Transistors 65 and 66 function as a phase-sensitive synchronous detector to provide across capacitor 67 and hence at the base input of transistor 70 an amplified DC voltage of a polarity corresponding to that across capacitor 50.

If there is insufficient toner in the liquid developer, then more light will fall on photovoltaic cell 18 than falls on reference cell 26. Accordingly, the positive voltage provided by cell 18 will exceed the negative voltage provided by cell 26; and the potential at the ungrounded terminal of capacitor 50 will be positive relative to ground. Flip-Flop 42 provides two square-wave outputs of opposite polarities. When the potential across resistor 45 is positive, transistors 52 and 65 conduct; and capacitor 63 is charged to a potential such that the drains of transistors 65 and 66 are at ground.

When the potential across resistor 48 is positive, transistors 53 and 66 conduct. Since amplifiers 55 and 59 each provide a phase inversion or reversal, the polarity of the output of amplifier 59 is the same as that at the ungrounded terminal of capacitor 50. Accordingly, the positive voltage at the ungrounded terminal of capacitor 50 appears as a positive voltage relative to ground at the drains of transistors 65 and 66. Since transistors 66 is conductive, capacitor 67 is charged to this amplified positive voltage. This causes transistor 70 to conduct, thereby energizing winding 71 to cause the addition of toner by means 72. As toner is added to the liquid developer, the transmittance thereof decreases; and the amount of light falling on cell 18 correspondingly decreases which reduces the voltage provided by cell 18. When the voltage provided by cell 18 decreases to that provided by reference cell 26, the voltage at the ungrounded terminal of capacitor 50 will drop to zero. The amplitude of the square wave output of chopper transistors 52 and 53 will likewise decrease to zero; and no square wave output will be provided at the collector of transistor 59. The voltage across capacitor 67 will decrease to zero; and transistor 70 will be rendered non-conductive. This deenergizes the winding 71 so that no more toner is added.

In order to vary the toner density in FIG. 2, the f-stop or aperture control 23 is adjusted to change the amount of light falling on the reference cell 26. For example, if it is desired to reduce the toner density, then f-stop 23 should be opened somewhat to provide a larger aperture and increase the amount of light falling on reference cell 26. An equal amount of light will fall on sensing cell 18 only if the density of the liquid developer is decreased by permitting the gradual exhaustion of its toner particles. If it is desired to increase the toner density, then f-stop control 23 should be closed somewhat to provide a smaller aperture and reduce the amount of light falling on reference cell 26. Winding 71 will immediately be energized to add toner and reduce the light falling on cell 18 until the voltages produced by cells 26 and 18 are again equal.

In general the intensity of light from lamp 14 falling on photovoltaic cells 18 and 26 will be sufficiently high that their output voltages will vary logarithmically with light intensity. In order to prevent drift in the null point with changes in line voltage at plug 30 and hence in the light intensity of lamp 14, it is necessary that substantially equal amounts of light fall on the cells 18 and 26. The cells should have substantially identical characteristics, so that the null point will not be shifted either by changes in temperature of the cells or by changes in the illumination of lamp 14 caused by variations in line voltage or by ageing of the lamp.

Referring now to FIG. 2*a*, there is shown a circuit for matching the characteristics of the two photovoltaic cells despite some slight mismatch due to manufacturing tolerances. Connected in series between the negative terminals of cells 18 and 26 is the resistance winding of a 1OK potentiometer 19. The slider of potentiometer is connected through 91K resistors 27 and 27*a* to the positive terminals of cells 18 and 26, respectively. A small load current flows from the positive terminal of cell 18 through resistor 27 into the slider of potentiometer 19 and thence through the right-hand portion of the resistance winding of potentiometer 19 to the negative terminal of cell 18. Similarly, a small load current flows from the positive terminal of cell 26 through resistor 27*a* to the slider of potentiometer 19 and thence through the left-hand portion of the resistance winding thereof to the negative terminal of cell 26. If the slider of potentiometer 19 is at the midpoint and cells 18 and 26 produce equal voltages, then the slider of potentiometer 19 will be positive relative to both terminals thereof. However, there will be no net difference in potential across the terminals of potentiometer 19. If the slider of potentiometer 19 is moved to the left, then the right-hand terminal thereof will become negative relative to its lefthand terminal, thereby adding in series with cells 18 and 26 a voltage which augments that of cell 26 and opposes that of cell 18. If the slider of potentiometer 19 is moved to the right, then the left-hand terminal thereof will become negative relative to its right-hand terminal, thereby adding in series with cells 18 and 26 a voltage which augments that of cell 18 and opposes that of cell 26. The slider of potentiometer 19 should be adjusted so that with cells 18 and 26 at the same temperature and with equal amounts of light falling on both cells, the voltage across capacitor 50 is zero.

Referring now to FIG. 3, wall plug 30 is connected to the primary winding 31 of transformer 32, having a center-tapped secondary winding 33. The center-tap is grounded; and the terminals of winding 33 are connected forwardly through respective diodes 35 and 36 to the positive terminal of capacitor 39, the negative terminal of which is grounded. Lamp 14 is connected across the terminals of winding 33. Photoconductive cells 18*a* and 26*a* are connected in series across the terminals of winding 33. Disposed in series between these cells is the resistance winding of a potentiometer 19*a*. The slider of potentiometer 19*a* is connected through capacitor 57 to the base of transistor 59, the emitter of which is grounded. The positive terminal of capacitor 39 is connected through resistor 60 to the collector of transistor 59, which is coupled to the base thereof through resistor 61. The collector of transistor 59 is connected through capacitor 63 to the collector of an n-p-n transistor 65*a*, the emitter of which is grounded. That terminal of winding 33 which is connected to cell 18*a* is also connected through a resistor 43 to the base of transistor 65*a*. The collector of transistor 65*a* is connected forwardly through a diode 66*a* to the base of transistor 70, having a grounded emitter. The base of transistor 70 is connected to ground through capacitor 67 which is shunted by a resistor 68. The positive terminal of capacitor 39 is connected through winding 71 of the toner addition relay 72 to the collector of transistor 70.

Transistor 65*a* and diode 66*a* comprise a synchronous detector which is sensitive only to signals of positive phase, and provides no output for signals of negative phase. It will be appreciated that a positive output across capacitor 67 causes transistor 70 to energize winding 71 and thereby add toner. However, since toner cannot be removed except gradually by continued operation of the machine, there is no necessity for providing negative voltages across capacitor 67. Accordingly, the detector of FIG. 3 could be employed in FIG. 2.

In operation of the circuit of FIG. 3, as toner is gradually depleted, the amount of light falling on cell 18*a* will exceed that falling upon cell 26*a*. This decreases the resistance of cell 18*a* and causes a small alternating voltage to appear at the slider of potentiometer 19*a* of a polarity corresponding to that applied to resistor 43. Transistor 59 amplifies this error signal and inverts its phase. Transistor 65*a* is rendered conductive during positive half cycles of the error signal at the slider of potentiometer 19*a* and hence during negative half cycles of the amplified error signal at the collector of transistor 59. This charges capacitor 63 such that the collector of transistor 65*a* is substantially at ground potential during negative half cycles of the amplified error signal from transistor 59. During positive half cycles of the amplified error signal from transistor 59, the collector of transistor 65*a* rises above ground potential and charges capacitor 67 through diode 66*a*. Transistor 70 is rendered conductive, exciting winding 71 and causing the addition of toner by relay 72. When sufficient toner has been added that the intensity of light falling upon cell 18*a* is decreased to that falling upon cell 26*a*, the error signal at the slider of potentiometer 19*a* decreases to zero. Since there is no output from amplifier 59 or from the synchronous detector, resistor 68 ensures that the base of transistor 70 returns substantially to ground potential thereby rendering transistor 70 non-conductive and deenergizing winding 71.

Photoconductive cells 18*a* and 26*a* have a dark resistance (or dark current) which varies as a function of temperature. In order to ensure that changes in cell temperature do not shift the operating point, it is necessary that at the desired operating point substantially equal amounts of light fall on photoconductive cells 18*a* and 26*a*. The cells should of course have similar characteristics. In order to compensate for slight mismatches in the characteristics of the two photoconductive cells, potentiometer 19*a* should be adjusted such that with both cells at the same temperature and with equal amounts of light falling on both cells, the alternating voltage at the slider of potentiometer 19*a* is zero.

Referring now to FIG. 4, wall plug 30 is connected to primary winding 31 of transformer 32 having a secondary winding 33*a*. One terminal of winding 33*a* is grounded, and the other terminal thereof is connected forwardly through diode 35 to the positive terminal of capacitor 39, the negative terminal of which is grounded. The ungrounded terminal of secondary winding 33*a* is connected backwardly through a diode 35*a* to the negative terminal of a capacitor 39*a*, the positive terminal of which is grounded. The voltage at the positive terminal of capacitor 39 may be +10 volts; and the voltage at the negative terminal of capacitor 39*a* may be −10 volts. The positive terminal of capacitor 39 is serially connected first through photoconductive cell 26*a* and then through photoconductive cell 18*a* to the negative terminal of capacitor 39*a*. The two cells are shunted by serially connected resistors 27 and 27*a*. Disposed between resistors 27 and 27*a* is the serially connected resistance winding of a potentiometer 19*b*. The junction of cells 18*a* and 26*a* is connected to the slider of potentiometer 19*b* and to the base of an n-p-n transistor 58*a*. The emitter of transistor 58*a* is connected to the emitter of an n-p-n transistor 58, the base of which is grounded. The common emitters of transistors 58 and 58*a* are connected through a 1OK resistor 62 to the negative terminal of capacitor 39*a*. The positive terminal of capacitor 39 is connected to the collector of transistor 58*a* and through a 1OK resistor 60 to the collector of transistor 58. The collector of transistor 58 is connected to the base of a p-n-p output transistor 70*a*. The positive terminal of capacitor 39 is connected backwardly through a 4.7 volt Zener diode 69 to the emitter of transistor 70*a*. The emitter of transistor 70*a* is connected through a 15K resistor 73 to the negative terminal of capacitor 39*a*. The collector of transistor 70*a* is connected through winding 71 of toner addition relay 72 to the negative terminal of capacitor 39*a*.

In operation of the circuit of FIG. 4, as toner is gradually depleted, more light falls upon cell 18*a* then upon cell 26*a*. This reduces the resistance of, or increases the current through, cell 18*a* so that the slider of potentiometer 19*b* drops below ground potential. Transistors 58 and 58*a* form a balanced direct-current amplifier. Each transistor normally draws 0.5 milliampere; and the collector of transistor 58 normally has a potential of about +5 volts. Zener diode 69 maintains the emitter of transistor 70*a* at a potential of substantially +5 volts. When the potential at the slider of potentiometer 19*b* drops below ground, conduction through transistor 58*a* decreases while conduction through transistor 58 increases. The potential at the collector of transistor 58 now decreases below +5 volts, rendering transistor 70*a* conductive. This energizes winding 71 causing toner to be added by means 72. When sufficient toner has been added that equal amounts of light fall on cells 18*a* and 26*a*, the voltage at the slider of potentiometer 19*b* rises to ground potential; the potential at the collector of transistor 58 rises to +5 volts; transistor 70*a* is rendered nonconductive; and winding 71 is deenergized so that no more toner is added.

Photoconductive cells 18*a* and 26*a* have a dark current (or dark resistance) which varies as a function of temperature. Unless both cells receive substantially equal amounts of light, the operating point of the system will drift with changes in temperature. However, if the cells have the same characteristics and receive equal amounts of light, then the operating or null point of the system will not shift with equal changes in temperature of the cells. In order to compensate for mismatch of the cells occasioned by manufacturing tolerances, potentiometer 19*b* should be adjusted such that with both cells at the same temperature and receiving the same amounts of light, the voltage at the slider of potentiometer 19*b* is zero.

In FIGS. 2*a*, 3, and 4, the adjustment of potentiometer 19, 19*a*, and 19*b* should be performed at the factory; and the only permissible user adjustment is the amount of light falling on reference cell 26 and 26*a*. In FIG. 3 the center-tapped secondary winding 33 provides a balanced, three-wire, low impedance source for exciting the serially-connected photoconductive or photoresistive devices with alternating current. The adjustment of potentiometer 19*a* in FIG. 3 serves not only to match the characteristics of the cells but also to compensate for slight manufacturing errors in the position or location of the center tap of the secondary winding of transformer 33. In FIG. 4, diodes 35 and 35*a* in conjunction with capacitors 39 and 39*a* provide a balanced, three-wire, low impedance source for exciting the serially-connected photoconductive or photoresistive devices with direct current. The adjustment of potentiometer 19*b* in FIG. 4 serves not only to match the characteristics of the cells but also to compensate for slight manufacturing differences in the relatively low forward impedance of rectifiers or diodes 35 and 35*a*. Thus, potentiometers 19*a* and 19*b* not only serve to match the cell characteristics but also to correct for slight imbalances in the relatively low impedance, three-wire, source.

In FIGS. 3 and 4 there is shown a further aperture or f-stop control, indicated generally by the reference numeral 23*a*, which includes a fixed semicircular aperture 22*a* (FIG. 3), which replaces polarizer 22 and a rotatable semicircular aperture 24*a* (FIG. 4), which replaces rotatable polarizer 24. For the relative alignment of the fixed and rotatable semicircular apertures shown in FIGS. 3 and 4, the amount of light falling on the reference cell is approximately one-quarter that which would exist if both apertures were removed. If aperture 24*a* is rotated counterclockwise through 90° from the position shown, the amount of light falling on the reference cell will increase to about half that which would exist if both apertures were removed. If aperture 24*a* is rotated clockwise through 90° from the position shown, the amount of light falling on the reference cell will be reduced to zero. Accordingly, it will be seen that manual rotation of knob 28 and hence of semicircular aperture 24*a* through a total angle of 180° results in a wide variation in the amount of light from lamp 14 which falls upon reference cell 26 or 26*a*.

In FIG. 1 (and in FIGS. 3 and 4) rotation of cap or knob 28 results in rotation of reference cell 26 (or 26*a*) relative to lamp 14. Furthermore, the distance of cap 28 and hence of the reference cell from lamp 14 changes with rotation of the cap due to advance of its screw threads. Motion of the reference cell away from lamp 14 reduces the amount of light falling upon the cell, while motion of the reference cell toward lamp 14 increases the amount of light falling upon the cell.

It will be seen that I have accomplished the objects of my invention. In my improved toner control system, a matched pair of photosensitive devices are connected in series and receive substantially equal amounts of light. Photovoltaic devices are connected in series opposition as in FIGS. 2 and 2*a*; and photoconductive or photoresistive devices are connected in series across a balanced, three-wire, relatively low impedance source of potential which may be either alternating-current as in FIG. 3, or direct-current as in FIG. 4. In my system, the desired toner density is adjusted by controlling the amount of light falling upon the reference cell. The amount of light may be varied either by controlling the intensity of illumination by the use of relatively rotatable polarizers as in FIG. 1, or by variable aperture or f-stop controls as in FIG. 2 and in FIGS. 3 and 4. Relative motion between the reference cell and the light source also varies the amount of light. My system is further provided with factory adjustments to match the characteristics of the cells despite slight manufacturing vagaries so that the desired toner density is maintained constant without drift either due to changes in temperature of the cells or due to changes in intensity of the illuminating lamp caused by ageing or by variations in the line voltage. As shown by Grubbs, the sensing cell 18 or 18*a* may respond either to light transmitted through a liquid developer or to light reflected from a solid developer. It will be further understood that light may be transmitted through the liquid developer to the sensing cell by placing cell 18 inside tank 10. Cell 18 may be placed in the position shown for mirror 16; and the mirror may be omitted. Light from lamp 14 would then pass through window 11 and then through developer 9 to fall upon cell 18.

It will be understood that certain features and subcombinations are of utility and may be employed without reference to other features and subcombinations. This is contemplated by and is within the scope of my claims. It will be further understood that various changes may be made in details within the scope of my claims without departing from the spirit of my invention.

Having thus described my invention, what I claim is:

1. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, adjustable control means for varying the amount of light falling upon the second device, means connecting the first and the second devices in series, means responsive to the serially-connected devices for supplying toner to the receptacle, and a substantially balanced three-wire source of potential, wherein the devices are photoconductive and are connected in series across said potential source.

2. A system as in claim 1 wherein said potential source provides direct-current potential.

3. A system as in claim 1 wherein said potential source comprises an inductive winding having a center tap.

4. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, adjustable control means for varying the amount of light falling upon the second device, said control means comprising a pair of relatively rotatable optical polarizers, means connecting the first and second devices in series, and means responsive to the serially-connected devices for supplying toner to the receptacle.

5. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, adjustable control means for varying the amount of light falling upon the second device, said control means comprising means for providing relative motion between the second device and the light source, means connecting the first and second devices in series, and means responsive to the serially-connected devices for supplying toner to the receptacle.

6. An improved toner control system including in combination a first and a second photoconductor device, a source of light, a receptacle containing toner and a carrier material, means for directing light from the source to the contents of the receptacle and from said contents to the first device, means for causing light from the source to fall upon the second device, a substantially balanced three-wire source of potential, means for connecting the first and the second devices in series across said potential source, and means responsive to the serially-connected photoconductive devices for supplying toner to the receptacle.

7. A system as in claim 6 wherein said potential source provides direct-current potential.

8. A system as in claim 6 wherein said potential source comprises an inductive winding having a center tap.

9. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, means including a pair of relatively rotatable polarizers for varying the amount of light falling upon the second device, and means responsive to the devices for supplying toner to the receptacle.

10. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, means for moving the second device relative to the light source, and means responsive to the devices for supplying toner to the receptacle.

11. An improved toner control system including in combination a first and a second photovoltaic cell each having a positive and a negative terminal, a source of light, a receptacle containing toner and a carrier material, means for directing light from the source to the contents of the receptacle and from said contents to one cell, means for causing light from the source to fall upon the other cell, a first resistor having a first and a second terminal and a relatively low resistance, means connecting the first terminal of the first resistor to a terminal of predetermined polarity of the first cell, means connecting the second terminal of the first resistor to that terminal of the second cell having said predetermined polarity, the two cells being connected in series opposition, a second resistor having a relatively high resistance, means connecting the second resistor between the other terminal of the first cell and the second terminal of the first resistor, and means responsive to the serially opposed cells for supplying toner to the receptacle.

12. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, and means responsive to the devices for supplying toner to the receptacle, said toner supplying means including synchronous detecting means and an alternating-current amplifier and means coupling the amplifier to the detecting means.

13. An improved toner control system including in combination a first and a second light sensitive device, a source of light, a receptacle containing toner and a carrier material, means for directing light from the source to the contents of the receptacle and from said contents to the first device, means for causing light from the source to fall upon the second device, and means responsive to the devices for supplying toner to the receptacle, the first and second devices providing a direct-current output, and the toner supplying means including means for converting said direct-current output into an alternating-current output and an alternating-current amplifier and means coupling the converting means to the amplifier.

14. An improved toner control system including in combination a first and a second photoconductor device, a source of light, a receptacle containing toner and a carrier material, means for directing light from the source to the contents of the receptacle and from said contents to the first device, means for causing light from the source to fall upon the second device, a source of alternating-current voltage, means responsive to said voltage source for exciting the first and second devices with alternating current, and means responsive to the two photoconductive devices for supplying toner to the receptacle.

* * * * *